US006964343B2

(12) United States Patent
Tilly

(10) Patent No.: US 6,964,343 B2
(45) Date of Patent: Nov. 15, 2005

(54) CONTAINER SYSTEM FOR ORGANIZING ITEMS

(76) Inventor: Jeffrey Tilly, 6557 W. Florence Ave., Phoenix, AZ (US) 85043

( * ) Notice: Subject to any disclaimer, the term of this patent is extended or adjusted under 35 U.S.C. 154(b) by 0 days.

(21) Appl. No.: 10/618,122

(22) Filed: Jul. 11, 2003

(65) Prior Publication Data

US 2004/0007548 A1 Jan. 15, 2004

Related U.S. Application Data

(60) Provisional application No. 60/426,849, filed on Nov. 15, 2002, provisional application No. 60/395,492, filed on Jul. 12, 2002.

(51) Int. Cl.[7] ..... A47B 73/00

(52) U.S. Cl. ..... 211/74; 211/76; 211/119.003; 312/245; 40/657

(58) Field of Search ..... 312/234.1, 280, 312/327, 328, 234.3, 234.5, 245; 248/309.1, 248/312, 312.1, 315; 211/85.4, 74, 75, 76, 211/85.18, 85.29, 71.01, 119.003, 84; D6/469, D6/457, 514; D7/600.1, 614, 701; 206/459.5, 206/562; 40/657

(56) References Cited

U.S. PATENT DOCUMENTS 2,155,884 A * 4/1939 Barnes ..... 211/74
2,580,676 A * 1/1952 Gross ..... 211/75
3,650,381 A * 3/1972 Weindling ..... 206/742
D267,762 S * 2/1983 Chase ..... D6/514
5,183,165 A * 2/1993 Acona et al. ..... 211/77
5,183,171 A * 2/1993 Pherigo ..... 220/258.3
5,664,689 A * 9/1997 Mirlisena, Sr. ..... 211/88.01
D408,694 S * 4/1999 Tisdale ..... D7/600.2
6,341,754 B1 * 1/2002 Melito et al. ..... 248/201
D483,233 S * 12/2003 Chen ..... D7/704
2002/0148363 A1 * 10/2002 Frommer et al. ..... 99/484
2002/0161464 A1 * 10/2002 Weiner ..... 700/97
2004/0099622 A1 * 5/2004 Lee ..... 211/85

* cited by examiner

*Primary Examiner*—Blair M. Johnson
(74) *Attorney, Agent, or Firm*—Stoneman Law Offices, Ltd.; Martin L. Stoneman

(57) ABSTRACT

A container system for organizing items that makes use of wasted space in or around cabinets, for use in organizing items such as spices or items used in construction and repair. The system comprises a substantially linear holder with apertures, containers that fit into the apertures, and caps that close the containers and stop the containers from going all the way through the apertures. The holder provides removable access of containers. The containers may be labeled for easy identification and organization.

The holder may have a cover with hinges and a latch. The system may be sold as a kit. The kit may be designed to match the cabinet it will be installed on.

The apparatus, kit, and methods of installation and use are disclosed.

28 Claims, 6 Drawing Sheets

CONTAINER SYSTEM FOR ORGANIZING ITEMS

CROSS-REFERENCE TO RELATED APPLICATIONS

The present application is related to applicant's prior U.S. Provisional Application No. 60/395,492, filed Jul. 12, 2002, entitled "CONTAINER SYSTEM FOR ORGANIZING ITEMS", and, U.S. Provisional Application No. 60/426,849, filed Nov. 15, 2002, entitled "CONTAINER SYSTEM FOR ORGANIZING ITEMS", the contents of which are hereby herein incorporated by reference and are not admitted to be prior art with respect to the present invention by their mention in this cross-reference section.

BACKGROUND

This invention relates to a container system for organizing items. This invention further relates to a container system for holding and organizing containers. More particularly, this invention concerns such a system that makes use of wasted space in or around cabinets, for use in organizing items, such as spices.

Typically, organizing systems take up a large amount of counter space, limiting the amount of available workspace and cluttering countertops. They may not match the surrounding cabinetry or appliances, and thus, may be unattractive. Other organizing systems may have many moving parts, which can become jammed.

In addition, the proliferation of varieties of spices stored in and around a typical kitchen area is very large; and many people store various spices in more than one place, e.g., cabinets, counters, spice racks, etc., making, among other problems, finding the right spice at the right time, difficult.

Thus, there exists a need for a system that overcomes such disadvantages.

OBJECTS OF THE INVENTION

A primary object and feature of the present invention is to provide a system for organizing containers that attaches to an available free-standing structure, leaving workspace on countertops and storage space in cabinets free of clutter.

It is a further object and feature of the present invention to provide such a system which allows the user to quickly identify the contents and location of a container, especially a spice container.

Another object and feature of the present invention is to provide such a system which matches the surrounding cabinetry.

It is a further object and feature of the present invention to provide such a system which is substantially free of moving parts.

An additional object and feature of the present invention is to assist one-handed access to containers used in cooking preparation (especially spice containers), constructing, or repair.

Another primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides an organizing system for organizing a plurality of items comprising: a plurality of long container means for holding the plurality of items; at least one substantially-vertical thin holding means for holding such plurality of long container means in at least one substantially horizontal position; wherein such at least one substantially-vertical thin holding means comprises a plurality of apertures; and at least one fastening means for fastening such at least one substantially-vertical thin holding means to at least one support structure; wherein, when at least one of such plurality of long container means is placed substantially through at least one of such plurality of apertures, a center of gravity of such at least one of such plurality of long container means effects a tilting of such at least one of such plurality of long container means such that, in combination with a small enough clearance between a diameter of such at least one of such plurality of apertures and a diameter of such at least one of such plurality of long container means, such at least one of such plurality of long container means is firmly held in such at least one of such plurality of apertures.

Moreover, it provides such a organizing system further comprising at least one capping means for capping such at least one of such plurality of long container means.

Additionally, it provides such a organizing system wherein such at least one capping means, when installed on such at least one of such plurality of long container means, comprises at least one stopping means, for such at least one of such plurality of long container means, for preventing such at least one of such plurality of long container means from passing all the way through such at least one of such plurality of apertures of such at least one substantially-vertical thin holding means.

Also, it provides such a organizing system further comprising at least one fastener retaining means for retaining such at least one fastening means within such at least one substantially-vertical thin holding means.

In addition, it provides such a organizing system wherein such at least one substantially-vertical thin holding means further comprises at least one space-saving means for using otherwise unused space adjacent such at least one support structure.

And, it provides such a organizing system wherein such at least one substantially-vertical thin holding means further comprises at least one color-matching means to match such at least one substantially-vertical thin holding means to the at least one support structure.

Further, it provides such a organizing system further comprising at least one position adjusting means to adjust at least one position of such at least one substantially-vertical thin holding means to permit removable access of such at least one of such plurality of long container means.

Even further, it provides such a organizing system further comprising at least one sifting means for sifting the plurality of items inside of such at least one of such plurality of long container means when such at least one of such plurality of long container means is inverted and shaken.

Moreover, it provides such a organizing system further comprising at least one labeling means for labeling such plurality of long container means. Additionally, it provides such a organizing system wherein such plurality of such long container means is for holding a plurality of spices. Also, it provides such a organizing system further comprising at least one guarding means structured and arranged to guard such plurality of long container means.

In addition, it provides such a organizing system further comprising at least one covering means structured and arranged to cover such plurality of long container means. And, it provides such a covering means further comprising at least one hinge means structured and arranged to flexibly connect such at least one covering means to such at least one substantially-vertical thin holding means. Further, it provides such a covering means further comprising at least one latching means structured and arranged to latch such at least one covering means in a closed position.

Even further, it provides such a organizing system wherein such at least one of such plurality of long container means comprises at least one stopping means, for such at least one of such plurality of long container means, for preventing such at least one of such plurality of long container means from passing all the way through such at least one of such plurality of apertures of such at least one substantially-vertical thin holding means.

In accordance with another preferred embodiment hereof, this invention provides an organizing system for organizing a plurality of spices comprising: a plurality of long containers structured and arranged to hold the plurality of spices; at least one substantially-vertical thin holder structured and arranged to hold such plurality of long containers in at least one substantially horizontal position; wherein such at least one substantially-vertical thin holder comprises a plurality of apertures structured and arranged to hold such plurality of long containers for removable access; wherein when at least one of such plurality of long containers is placed substantially through at least one of such plurality of apertures, such at least one of such plurality of apertures is structured and arranged to provide at least one friction hold around at least one circumferential portion of such at least one of such plurality of long containers; wherein a center of gravity position of such at least one of such plurality of long containers aids such at least one friction hold; and at least one fastener structured and arranged to fasten such at least one substantially-vertical thin holder to at least one support structure.

Moreover, it provides such a organizing system further comprising at least one retainer structured and arranged to retain such at least one fastener within such at least one substantially-vertical thin holder. Additionally, it provides such a organizing system further comprising at least one position adjuster structured and arranged to adjust at least one position of such at least one substantially-vertical thin holder to ensure removable access of such at least one of such plurality of long containers.

Also, it provides such a organizing system further comprising at least one cap structured and arranged to cap such at least one of such plurality of long containers.

In addition, it provides such a organizing system wherein such at least one cap, when installed on such at least one of such plurality of long containers, provides at least one stop for such at least one of such plurality of long containers, to prevent such at least one of such plurality of long containers from passing all the way through such at least one of such plurality of apertures of such at least one substantially-vertical thin holder.

And, it provides such a organizing system further comprising at least one sifter structured and arranged to sift at least one of such plurality of spices inside of such at least one of such plurality of long containers when such at least one of such plurality of long containers is inverted and shaken. Further, it provides such a organizing system further comprising at least one label structured and arranged to label such at least one of such plurality of long containers. Even further, it provides such a organizing system wherein such at least one label comprises indicia.

Moreover, it provides such a organizing system further comprising at least one guard structured and arranged to guard such plurality of long containers. Additionally, it provides such a organizing system further comprising at least one cover structured and arranged to cover such plurality of long containers. Also, it provides such a at least one cover further comprising at least one hinge structured and arranged to flexibly connect such at least one cover to such at least one substantially-vertical thin holder.

In addition, it provides such a at least one cover further comprising at least one latch structured and arranged to latch such at least one cover in a closed position. And, it provides such a organizing system wherein such at least one of such plurality of long containers further comprises at least one stop for preventing such at least one of such plurality of long containers from passing all the way through such at least one of such plurality of apertures of such at least one substantially-vertical thin holder.

In accordance with another preferred embodiment hereof, this invention provides an organizing system for organizing spices comprising: a plurality of long containers structured and arranged to hold a plurality of spices; at least one substantially-vertical holder structured and arranged to hold such plurality of long containers in at least one substantially horizontal position; wherein such at least one substantially-vertical holder comprises a plurality of apertures structured and arranged to hold such plurality of long containers for removable access; wherein at least one of such plurality of apertures is structured and arranged to provide at least one friction hold around at least one circumferential portion of at least one of such plurality of long containers; wherein at least one position of the center of gravity of such at least one of such plurality of long containers aids such at least one friction hold; at least one fastener structured and arranged to fasten such at least one substantially-vertical holder to at least one support structure; a plurality of caps structured and arranged to cap at least one of such plurality of long containers; and a plurality of sifters structured and arranged to sift such plurality of spices inside of such plurality of long containers when such plurality of long containers are inverted and shaken.

In accordance with another preferred embodiment hereof, this invention provides a consumer kit for a spice organizing system comprising kit contents; and consumer packaging material packaging such kit contents; wherein such consumer packaging material comprises indicia indicating at least one specific color and size; wherein such kit contents comprise: at least one set of spacers, at least one set of long containers, at least one set of cover caps, at least one set of sifters, at least one set of labels, at least one compact disc program for creating labels, at least one holder, wherein such holder comprises at least one fastener retainer, at least one set of fasteners, and at least one set of instructions for installation of the spice organizing system.

Further, it provides such a kit contents further comprising at least one set of cards, at least one compact disk program for creating cards, and at least one cover. Even further, it provides such a kit contents further comprising at least one latch. Even further, it provides such a kit contents further comprising at least one hinge.

In accordance with another preferred embodiment hereof, this invention provides a method of installing a spice organizing system comprising the steps of: measuring at least one support structure on which to install the spice organizing system; selecting at least one consumer kit for the spice organizing system which is appropriately sized and color-matched to the at least one support structure; drilling at least one pilot hole in the at least one support structure; selecting at least one spacer of appropriate size so as to offset the location of at least one substantially-vertical thin holder when installed to a position that provides removable access for a plurality of long containers held within; installing at least one fastener through such at least one substantially-vertical thin holder, through such at least one spacer, and into the at least one support structure for retention of such at least one substantially-vertical thin holder; and installing at least one sifter and at least one cap on at least one of such plurality of long containers; and placing such plurality of long containers into a plurality of apertures of such at least one substantially-vertical thin holder.

Even further, it provides such a steps further comprising the step of installing at least one cover on such at least one substantially-vertical thin holder.

In accordance with another preferred embodiment hereof, this invention provides a method of use of a spice organizing system comprising at least one substantially-vertical thin holder installed on at least one support structure, comprising the steps of: filling a plurality of long containers with a plurality of items; installing a plurality of sifters on such plurality of long containers; installing a plurality of caps to enclose such plurality of long containers; creating a plurality of labels for such plurality of long containers; placing such plurality of labels on such plurality of caps to identify a plurality of contents inside of such plurality of long containers; selecting at least one aperture of such at least one substantially-vertical thin holder into which at least one of such plurality of long containers should be stored; and placing such at least one of such plurality of long containers in such at least one aperture of such at least one substantially-vertical thin holder.

Even further, it provides such a steps further comprising the steps of: creating a plurality of cards for such plurality of long containers; and placing such plurality of cards on the cover of the such at least one substantially-vertical thin holder to identify a plurality of contents inside of such plurality of long containers.

DETAILED DESCRIPTION OF THE BEST MODE AND PREFERRED EMBODIMENTS OF THE INVENTION

Figure 1:
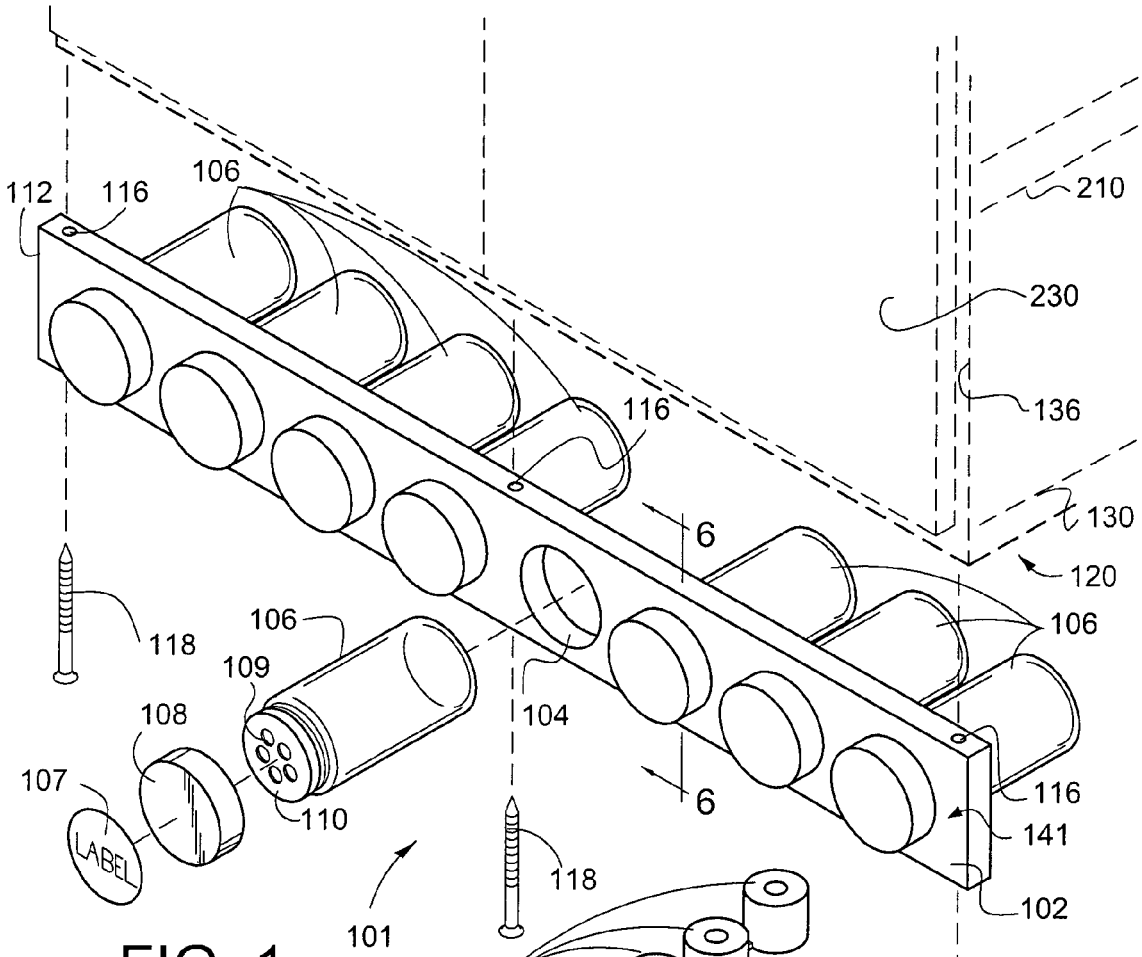
FIG. 1 shows a perspective view of the organizing system according to a preferred embodiment of the present invention.

Reference is now made to the Drawings. FIG. 1 is a perspective view of an organizing system 101 according to a preferred embodiment of the present invention. FIG. 1 illustrates the installation and use of the organizing system 101 as preferably used for a spice rack, for example. Those skilled in the art, upon reading the teachings of this specification, will appreciate that, under appropriate circumstances, considering such issues as economy, weight, strength of materials, dimensions, support, etc., other uses for the organizing system 101 (illustrated, as preferred, for spices) of the present invention, such as organizing, for example, nails, screws, paperclips, etc., may suffice. Preferably, the organizing system 101 (as shown) comprises a holder 102, which has apertures 104 for holding containers 106, as shown.

Preferably, the holder 102 is "thin" and is preferably made from a stiff material, preferably plastic, preferably injection-molded plastic. Upon reading this specification, those skilled in the art will understand that, under appropriate circumstances, such as issues of economy, matching decor, availability of tools or materials, etc., other materials, such as fiberboard, fiberboard with a melamine finish, wood, steel, etc., may suffice. A "thin" holder, as used herein, means a holder having a thickness of about ten percent to about forty percent of the length of the containers proposed for use with such holder 102. Preferably, such "thin" holder has a width of about twenty-five percent of the length of the containers 106, preferably about three-quarters-inch thick for the illustrated embodiment showing a container 106 about three-inches long. Upon reading this specification, those skilled in the art will understand that, under appropriate circumstances, such as issues of material strengths, container diameters, coefficients of friction, proposed typical container weight, etc., other thicknesses that hold the containers 106, may suffice.

Preferably, the "length" of the holder 102 is about the length adjacent the position on the support structure 120 (herein a user-preferred cabinet, such as that shown is used to illustrate a support structure 120 for supporting the organizing system 101) the holder 102 is to be installed. For example, a standard cabinet length of forty-two-inches sizes (horizontally) would utilize a forty-two-inch long holder 102. Preferably, the holder 102 is manufactured in two-inch to three-inch increasing incremental lengths starting from about twenty-four inches and going to about forty-eight inches in length to match typical stock cabinet sizes. Upon reading this specification, those skilled in the art will understand that, under appropriate circumstances, other lengths, such as, for example, a vertical length, height, etc., which are readily attachable to a supporting structure and hold a suitable number of containers 106, may suffice. Further, upon reading the teachings of this specification, those with ordinary skill in the art, will now understand that, under appropriate circumstances, considering issues such as English or Metric measurement etc., other dimensional increases and overall holder 102 sizes, such as increasing by four-inch increments, etc., may suffice.

Preferably, for the illustrated embodiment, each standard forty-two-inch holder 102 has enough apertures 104 to hold preferably eighteen "long" containers 106, as shown. As used herein, "long" means about two-and one-half to about ten times the thickness of the "thin" holder 102, most preferably about four times such thickness. Preferably, the "width" of the holder 102 (as the term is used herein), is about two-inches to about three-inches, preferably variable to suit the diameter of a container 106 (herein embodying a plurality of long container means for holding the plurality of items, and further embodying herein a plurality of long containers structured and arranged to hold the plurality of spices). Upon reading the teachings of this specification, those with ordinary skill in the art, will now understand that, under appropriate circumstances, considering issues such as user preference, use, shipping considerations, durability, etc., other quantities and dimensions for the holder 102, may suffice.

Preferably, the containers 106 are cylinders, preferably round cylinders, as shown. Upon reading this specification, those skilled in the art will understand that, under appropriate circumstances, other "cylinder" shapes may suffice, such as, for example, octagonal or square cross-sections or even tapered cross-section shapes, or other appropriate shapes that would provide the functions herein taught. Preferably, the containers 106 are made of glass, preferably flint glass, preferably flint glass with a "48–485" neck size (typical for spice containers). Upon reading this specification, those skilled in the art will understand that, under appropriate circumstances, other materials, such as plastic, steel, tin, etc., may suffice. Furthermore, upon reading the teachings of this specification, those with ordinary skill in the art, will now understand that, under appropriate circumstances, considering issues such as container use, economic considerations, user preference, etc., other dimensions of the container 106, such as neck and cap sizes smaller or larger than "48–485", etc., may suffice.

Preferably, for the spice rack example shown in FIG. 1, the containers have the nominal dimensions of one and three-quarters-inches in outer diameter by three and one-half-inches in length (herein embodying wherein such plurality of said long container means is for holding a plurality of spices). Preferably, they are three and one-half-ounce jars. Upon reading this specification, those skilled in the art will understand that, under appropriate circumstances, other applications of the organizing system 101 in which the firm holding and removable access of other containers (having, for example, at least one cross-section portion which may interact as taught herein with the holder apertures), such as wine bottles, condiment bottles, etc., may suffice.

Preferably, each container 106 (as for spices) has a cap 108 (herein embodying at least one capping means for capping such at least one of said plurality of long container means) and a sifter 110, as shown. Preferably, the cap 108 and sifter 110 are installed after filling the container 106 (herein embodying installing at least one sifter and at least one cap on at least one of said plurality of long containers, also embodying herein filling a plurality of long containers with a plurality of items, and further embodying herein installing a plurality of sifters on such plurality of long containers, and further embodying herein installing a plurality of caps to enclose such plurality of long containers). Preferably, the cap 108 is a screw-on lid. Upon reading this specification, those skilled in the art will understand that, under appropriate circumstances, another kind of cap may suffice, such as a flip-top cap (also known as a "flapper"), a flip-top cap with a built-in sifter, a screw-on lid with a flip-top portion, etc.

Preferably, the cap 108 is made of a light, stiff material, preferably plastic. Upon reading this specification, those skilled in the art will understand that, under appropriate circumstances, other materials, such as metal, etc., may suffice. Preferably, the sifter 110 has multiple holes 109, preferably five holes 109, preferably some sifters 110 with five small holes 109, and some with five large holes 109. Upon reading this specification, those skilled in the art will understand that, under appropriate circumstances, such as spice size, desired flow rate, etc., other quantities of holes 109 and arrangements of holes 109 in the sifter 110 (which allow spices to be evenly dispensed when the container 106 is shaken upside down), such as, for example, four holes etc., may suffice (herein embodying at least one sifting means for sifting the plurality of items inside of said at least one of said plurality of long container means when said at least one of said plurality of long container means is inverted and shaken).

Preferably, there is a label 107 corresponding to each respective container 106, as shown (herein embodying at least one labeling means for labeling said plurality of long container means). Preferably, the labels 107 will allow the user to identify and order the containers 106 in an organized manner when the containers 106 are placed in the holder 102 (embodying herein placing such plurality of long containers into a plurality of apertures of such at least one substantially-vertical thin holder; also herein embodying placing such plurality of labels on such plurality of caps to identify a plurality of contents inside of such plurality of long containers; further herein embodying selecting at least one aperture of such at least one substantially-vertical thin holder into which at least one of such plurality of long containers should be stored; further herein embodying placing such at least one of such plurality of long containers in such at least one aperture of such at least one substantially-vertical thin holder). Upon reading this specification, those skilled in the art will understand that, under appropriate circumstances, such as intended use, contents, etc., other means of identifying and organizing the containers 106, such as by color coding, unlabeled placement, etc., may suffice.

Preferably, fasteners 118 attach the holder 102 to a supporting structure 120 (herein embodying at least one fastening means for fastening said at least one substantially-vertical thin holding means to said at least one support structure), preferably through fastener holes 116 located on the ends and the middle of each holder 102, as shown. Upon reading this specification, those skilled in the art will understand that, under appropriate circumstances, such as heavy use, support structure requirements, etc., other arrangements of fastener holes 116 that adequately support the holder 102 may suffice. Preferably, the fasteners 118 are screws, as shown, preferably wood screws (when being installed in a wood cabinet, as shown).

Preferably, the organizing system 101 is suitable for retrofitting on existing cabinets, overhangs, or ledges, where previously un-used space can be utilized, thereby saving counter space or other space which may be utilized other than under such existing cabinets, overhangs, or ledges, as shown (herein embodying wherein said at least one substantially-vertical thin holding means further comprises at least one space saving means for using otherwise unused space adjacent said at least one support structure). Upon reading this specification, those skilled in the art will understand that, under appropriate circumstances, such as kitchen design, user habits, etc., other supporting structures, such as walls, ceilings, stove hoods, shelves, etc., may suffice. Preferably, holder 102 is used in a "substantially vertical position" (herein embodying wherein said at least one substantially-vertical thin holding means comprises a plurality of apertures). As used herein, "substantially vertical" means the face 141 of the holder 102 is in a plane, which will visually match the appearance of the vertical sides of the supporting structure 120 on which it is installed, as shown. As shown, the apertures 104 hold the containers 106 in a "substantially horizontal position" (herein embodying at least one substantially-vertical thin holding means for holding said plurality of long container means in at least one substantially horizontal position). As used herein, "substantially horizontal" means substantially perpendicular to the face 141 of the "substantially vertical" holder 102.

Figure 2A:
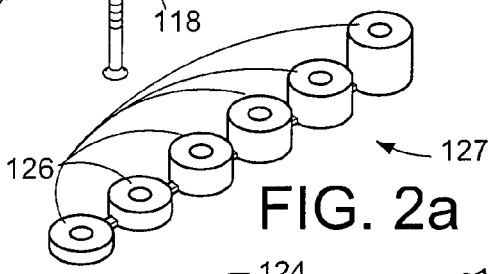
FIG. 2*a* shows a perspective view of a preferred set of spacers for adjusting the position of the organizing system of FIG. 1 when attached to a support structure, as shown in FIG. 2.
Figure 2:
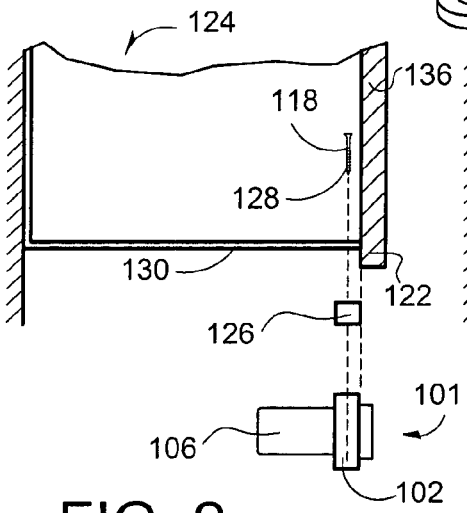
FIG. 2 shows a side view, partially in section, illustrating installation of the organizing system on the underside of a cabinet structure of FIG. 1 according to a preferred embodiment of the present invention.

FIG. 2 is a side view, partially in section, illustrating installation of the organizing system 101 of FIG. 1, on a cabinet structure 124, according to a preferred embodiment of the present invention. Preferably, an installer (herein referring to the person or persons responsible for installing the holder 106, including the end-user) measures the width of the cabinet structure 124 on which the holder 102 is to be installed (herein embodying measuring at least one support structure on which to install the spice organizing system). Preferably, the installer selects a consumer kit 145 (see FIG. 8 for details) for the organizing system 101, which is appropriately sized and color-matched (herein embodying wherein such at least one substantially-vertical thin holding means further comprises at least one color-matching means to match such at least one substantially-vertical thin holding means to the at least one support structure; and further herein embodying selecting at least one consumer kit for the organizing system, which is appropriately sized and color-matched to the at least one support structure). Upon reading this specification, those skilled in the art will understand that, under appropriate circumstances, such as user preference, available materials, etc., other sizes, finishes, and colors may suffice. Furthermore, upon reading the teachings of this specification, those with ordinary skill in the art, will now understand that, under appropriate circumstances, considering issues such as convenience, user preference, installer availability, etc., other sequences of selection and measuring, may suffice.

As shown in FIG. 2, the holder 102 may be installed behind the overhang 122 (along the bottom underside of the cabinet box) of a cabinet structure 124. For this installation, it is preferred that a spacer 126 (as shown in FIG. 2*a*) is used at each fastener hole 116, to ensure that the holder 102 is situated so as to allow removable access of the containers 106 in and out of the holder 102, without interference with the overhang 122 or other supporting structure 120, as shown (herein embodying at least one position adjusting means to adjust at least one position of said at least one substantially-vertical thin holding means to permit removable access of said at least one of said plurality of long container means, and further yet embodying herein wherein such at least one substantially-vertical thin holder comprises a plurality of apertures structured and arranged to hold such plurality of long containers for removable access). Upon reading this specification, those skilled in the art will understand that, under appropriate circumstances, other methods of adjusting the location of the holder 102, such as using long attachment fasteners, increasing the width of the holder 102, etc., may suffice.

In the illustrated embodiment in FIG. 2, the holder 102 is attached to the cabinet structure 124 by inserting fasteners 118 downward through the floor 130 of the cabinet structure 124 through spacers 126, and into the holder 102, so that the threads 128 of the fastener 118 seat in the holder 102, as shown (herein embodying installing at least one fastener through such at least one substantially-vertical thin holder, through such at least one spacer, and into the at least one support structure for retention of said at least one substantially-vertical thin holder). Upon reading this specification, those skilled in the art will understand that, under appropriate circumstances, such as other materials, other uses, etc., other fastener attachments that adequately suspend the holder 102, such as bolts, adhesives, and clips, etc., may suffice.

FIG. 2*a* is a perspective view of a preferred set 127 of spacers 126 for adjusting the position of a preferred holder 102 of the organizing system of FIG. 1, when attached to a cabinet structure 124, as shown in FIG. 2. A spacer 126 of appropriate height is selected from a set 127 provided and is placed between the holder 102 and the cabinet structure 124 to adjust the offset of the holder 102 from the cabinet 124, ensuring removable access of the containers 106, as shown (herein embodying selecting at least one spacer of appropriate size so as to offset the location of at least one substantially-vertical thin holder when installed to a position that provides removable access for a plurality of long containers held within). Preferably, the spacers 126 are made of plastic, preferably injection-molded plastic, preferably styrene, preferably crystallized styrene plastic. Upon reading this specification, those skilled in the art will understand that, under appropriate circumstances, such as user preference, aesthetic design, and structural requirements, other spacer materials, such as metal, wood, rubber, etc., may suffice.

Figure 3:
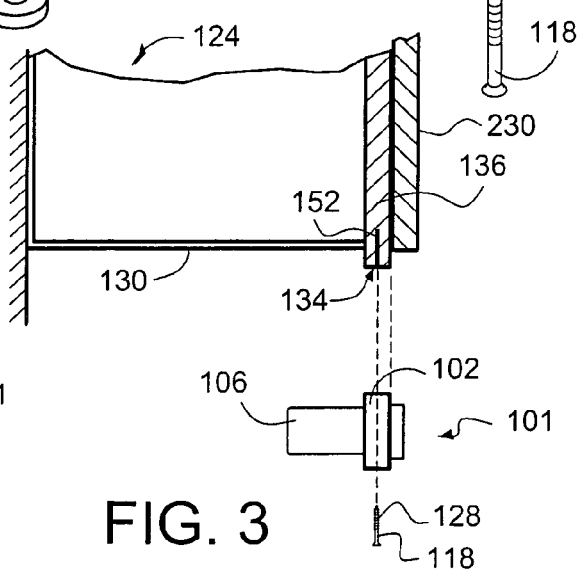
FIG. 3 shows a side view, partially in section, illustrating an alternate installation of the organizing system of FIG. 1 on the underside of a cabinet structure according to an alternate preferred embodiment of the present invention.

FIG. 3 is a side view illustrating an alternate installation of the organizing system 101 of FIG. 1, on a cabinet structure 124, according to an alternate preferred embodiment of the present invention. As shown in FIG. 3, the holder 102, in this example, attaches directly on the bottom-edge 134 of the face-frame 136 of the cabinet structure 124. As shown in FIG. 3, the holder 102 is fastened to the cabinet structure 124 by inserting fasteners 118 upward through fastener holes 116 in the holder 102 (shown in FIG. 1), so that the threads 128 seat in the face-frame 136 of the cabinet structure 124, as shown. Upon reading this specification, those skilled in the art will understand that, under appropriate circumstances, such as user preference, other uses, etc., other fastener attachment methods, such as nails, adhesives, clips, bolts, etc., may suffice.

Preferably, pilot holes 152 are drilled in the cabinet structure 124 (herein embodying drilling at least one pilot hole in the at least one support structure), so as to preferably prevent spalling and cracking of the substrate material, when fasteners 118 are installed to attach the holder 102. Preferably, the fastener holes 116 are located on the cabinet structure 124, by preferably placing the holder 102 next to the cabinet structure 124, preferably inserting fasteners 118 through the pre-drilled fastener holes 116 in the holder 102 until they preferably stick out the far side of the holder 102, then preferably marking the locations where the inserted fasteners 118 would preferably impact the cabinet structure 124. Upon reading this specification, those skilled in the art will understand that, under appropriate circumstances, such as construction methods, placement, attachment method, etc., other methods of locating the pilot holes 152 in the cabinet structure 124, such as mate-drilling pilot holes, using self-tapping screws, etc., may suffice.

Figure 4:
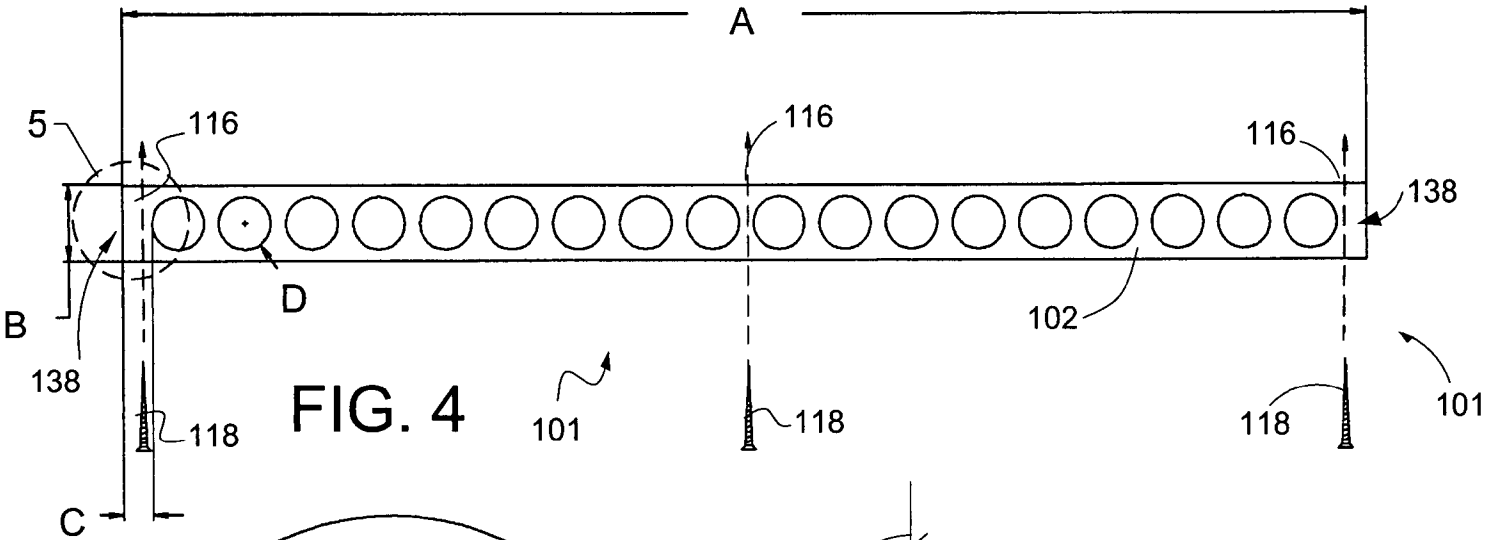
FIG. 4 shows a front view further illustrating the alternate installation of the organizing system of FIG. 3.

FIG. 4 is a front view illustrating the alternate installation of FIG. 3 on a cabinet structure 124, according to a preferred embodiment of the present invention. In FIG. 4, the preferred mounting location of each fastener hole 116 in the holder 102 is shown. Most preferably, at least one fastener 116 is used on each end portion and in about the middle of the holder 102, as shown. Upon reading this specification, those skilled in the art will understand that, under appropriate circumstances, other fastener hole locations that allow adequate attachment of the holder 102 to a supporting structure (shown in FIG. 1) may suffice.

Also shown in FIG. 4 is "length" A, "width" B, "tear-out distance" C, of holder 102, and "diameter" D, of aperture 104. Preferably, the "tear-out distance" C between apertures 104 on the end of the holder 102, and the edge 138 of the holder 102 is adequate to allow enough room for a fastener recess 132, further shown in FIG. 5, preferably at least one-inch, in the illustrated embodiment. Upon reading this specification, those skilled in the art will understand that, under appropriate circumstances, such as when small "tear-out distances" C, won't compromise the integrity of the attachment of the holder, other "tear-out distances" may suffice.

Figure 5:
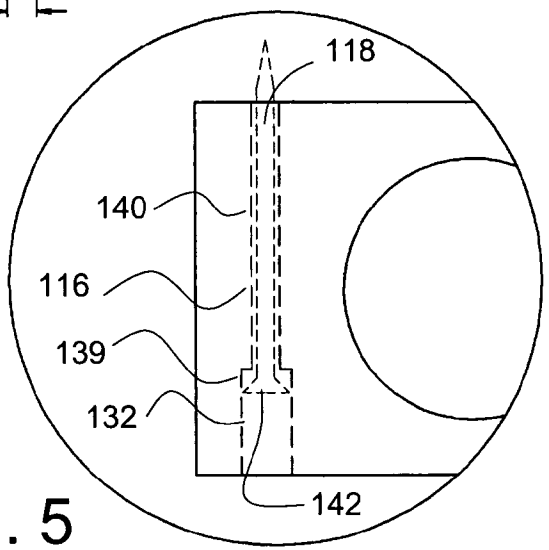
FIG. 5 shows an enlarged view of Detail 5 of FIG. 4.

FIG. 5 is an enlarged view of the detail 5 of FIG. 4 illustrating a preferred fastener recess 132 of the preferred holder 102, according to a preferred embodiment of the present invention, as shown (herein embodying at least one fastener retaining means for retaining such at least one fastening means within such at least one substantially-vertical thin holding means). As shown in FIG. 5, the fastener hole 116 preferably consists of a thin pilot hole portion 140 and a larger diameter countersink portion 139. The fastener 118 is preferably installed upward through the fastener hole 116, as shown, until preferably the fastener head 142 is seated at the end of the countersink portion 139. Preferably, the diameter of the fastener head 142 prevents it from traveling any further through the fastener hole 116, as shown. Upon reading this specification, those skilled in the art will understand that, under appropriate circumstances, such as other attachment means, varying screw head diameters, etc., other fastener hole configurations, such as narrower or wider holes, deeper or shallower holes, user drilled holes, or non-countersunk holes, which allow adequate fastener retention, may suffice.

Figure 6:
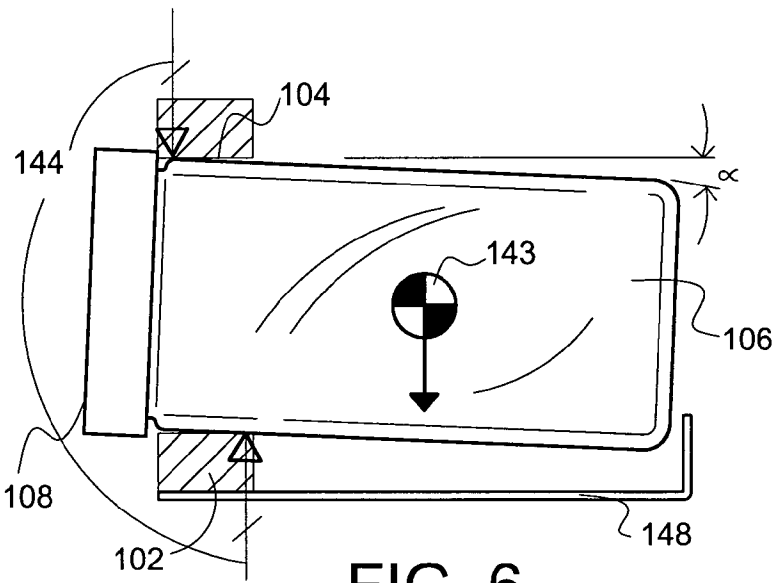
FIG. 6 shows a section view through the section 6—6 of FIG. 1.

FIG. 6 is a sectional view through the section 6—6 of FIG. 1 illustrating how a preferred container 106 is held by an aperture 104 of the preferred holder 102, according to a preferred embodiment of the present invention. Preferably, for the spice rack application, the inner diameter "D" of the aperture 104 is about five-one-hundreths-inch larger than the outer diameter of the container 106. Preferably, the outer diameter of the container 106 is about one and three-quarters inches in the illustrated embodiment. Upon reading this specification, those skilled in the art will understand that, under appropriate circumstances, such as when the organizing system is used with other diameter containers, using other shaped containers, etc., other clearances between the diameter of the container and the diameter of the aperture may suffice. As shown in FIG. 6, preferably the outer diameter of the cap 108 on the container 106 is slightly larger than the diameter of the container 106, preferably at least five-one-thousandths inch larger than the diameter of the container 106, most preferably, occurring when the cap 108 is placed in a three-quarter-inch thick holder 102, as shown. Upon reading this specification, those skilled in the art will understand that, under appropriate circumstances, such as when the organizing system is used with other diameter containers, other specifications for the diameter of the cap 108, may suffice.

Preferably, the cap 108 rests against the holder 102 when the container 106 has been installed within the aperture 104 of the holder 102, preventing the container 106 from sliding all the way through the aperture 104, as shown (herein embodying wherein such at least one capping means, when installed on such at least one of said plurality of long container means, comprises at least one stopping means, for such at least one of said plurality of long container means, for preventing such at least one of said plurality of long container means from passing all the way through said at least one of said plurality of apertures of said at least one substantially-vertical thin holding means).

Preferably, the center of gravity 143 of the container 106 is located offset from the holder 102, so as to create a moment on the container 106, reacted by a force couple 144, as shown in FIG. 6. Preferably, the container 106 rotates downward slightly when installed in the aperture 104 until contact is achieved (as shown, see angle $\alpha$) on alternating upper and lower surfaces of the aperture 104, and preferably the force couple 144 (with appropriate friction) restrains the container 106, as shown in FIG. 6 (herein embodying wherein, when at least one of said plurality of long container means is placed substantially through at least one of said plurality of apertures, a center of gravity of said at least one of said plurality of long container means effects a tilting of said at least one of said plurality of long container means such that, in combination with a small enough clearance between a diameter of said at least one of said plurality of apertures and a diameter of said at least one of said plurality of long container means, said at least one of said plurality of long container means is firmly held in said at least one of said plurality of apertures). The components of the restraining forces, acting normal to the surface of the container 106, help to hold the container 106 in place by friction (herein embodying wherein a center of gravity position of said at least one of said plurality of long containers aids such at least one friction hold).

Container 106 may be shaped and configured to stop container 106 from sliding through aperture 104. For example, container 106 may comprise a flange that is wider than aperture 104 adjacent to cap 108 (embodying herein wherein said at least one of said plurality of long container means comprises at least one stopping means, for said at least one of said plurality of long container means, for preventing said at least one of said plurality of long container means from passing all the way through said at least one of said plurality of apertures of said at least one substantially-vertical thin holding means). Upon reading this specification, those skilled in the art will understand that, under appropriate circumstances, such as other uses, decorative designs, etc., other methods for holding the container 106 within the aperture 104, such as a tapering bottle, a bottle with a stopping portion molded in, etc., may suffice.

Alternately, upon reading this specification, those skilled in the art will understand that, under appropriate circumstances, such as use directly over a stove, aesthetic reasons, or heavy use in a commercial kitchen, a guard 148 (see FIG. 6) for visual protection, heat protection, or accidental dislodgement protection may be attached to the holder 102 adjacent the containers 106, as shown (embodying herein at least one guarding means structured and arranged to guard said plurality of long container means).

Figure 7:
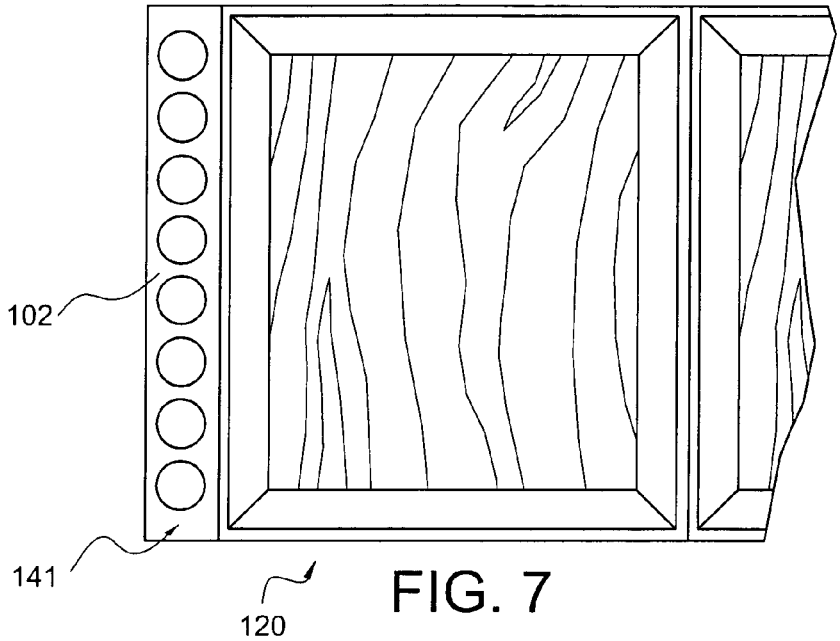
FIG. 7 shows a front view, partially in section, illustrating the holder attached to a side of a cabinet support structure according to an alternate preferred embodiment of the present invention.

FIG. 7 is a front view, partially in section, illustrating how the preferred holder 102 may be attached to a vertical side of a support structure 120, according to an alternate preferred embodiment of the present invention. As shown in FIG. 7, the holder 102 may be aligned in a variety of orientations as long as the face 141 of the holder 102 remains in a "substantially vertical" plane.

Figure 8:
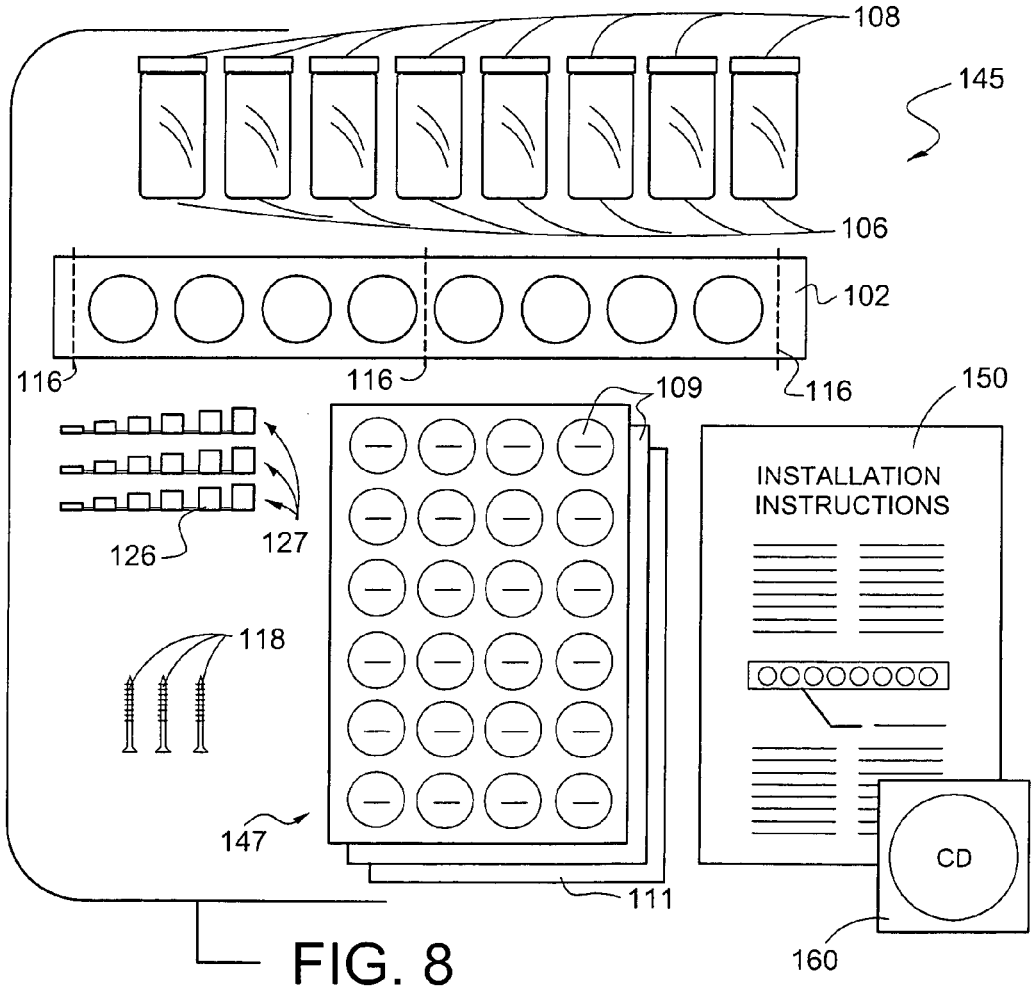
FIG. 8 shows a plan view illustrating the preferred contents of a preferred consumer kit according to a preferred embodiment of the present invention.

Reference is now made to FIG. 8 with continued reference to the above Figures. FIG. 8 is a plan view illustrating the preferred contents of a preferred consumer kit 145 according to a preferred embodiment of the present invention. Preferably, as shown in FIG. 8, the organizing system 101 is sold as a consumer kit 145, preferably consisting of a set of containers 106, a set of caps 108, a set of sifters 110 (an example of which is shown in FIG. 1), a holder 102 with means for fastener retention, preferably three sets of spacers 127 for the three sets of fastener holes 116 in the holder 102, preferably three fasteners 118 (preferably screws), preferably a set of labels 147, preferably installation instructions 150 (herein embodying wherein said kit contents comprise: at least one set of spacers, at least one set of long containers, at least one set of cover caps, at least one set of sifters, at least one set of labels, at least one holder, wherein such holder comprises at least one fastener retainer, at least one set of fasteners, and at least one set of instructions for installation of the spice organizing system), and preferably consumer packaging material 146 (herein embodying at least one consumer packaging material packaging said kit contents), shown in FIG. 11, which indicates the size, color, and finish 155 (illustrated in FIG. 10) of the holder 102. Upon reading this specification, those skilled in the art will understand that, under appropriate circumstances, such as intended use, organizing system size, etc., a different quantity of items, such as more than three fasteners, may suffice in the consumer kit, where alternate quantities still provide for the organizing system to be installable and functional.

Preferably (as is shown in FIG. 2), the outer diameter of each spacer 126 is the same as the thickness of the holder 102, preferably three-quarter-inch. Upon reading this specification, those skilled in the art will understand that, under appropriate circumstances, such as aesthetic design, strength of materials, etc., other spacer diameters that adequately allow adjustment of the location of the holder may suffice. Preferably, the set of spacers 127 consists of spacers 126 of the following heights: one-eighth-inch, one-quarter-inch, three-eighths-inch, one-half-inch, five-eighths-inch and three-quarter-inch. Upon reading this specification, those skilled in the art will understand that, under appropriate circumstances, such as custom cabinets, ceiling installation, Metric or English dimensions, etc., other sets and dimensions of spacer heights which adequately allow adjustment of the location of the holder, may suffice.

As shown, the consumer kit 145 preferably includes a set of labels 147 of common spices. Preferably, there are forty-eight labels 109 (see FIG. 9) of common spices included, as well as a set of blank labels 111, which the user can label manually. Upon reading this specification, those skilled in the art will understand that, under appropriate circumstances, such as commercial use, regional variations, etc., other quantities of labels of common spices may be supplied. As a preferred alternate embodiment, a template is provided in the consumer kit 145 on compact disc 160 (herein embodying at least one compact disc program for creating labels), as shown, so that customized labels can be created from the blank labels 111. Those skilled in the art of label production with software will be able, without undue experimentation, to provide such program and template, etc. Upon reading this specification, those skilled in the art will understand that, under appropriate circumstances, such as other materials, other organization systems, etc., other methods of creating customized labels, such as by handwriting on blank labels 111, may suffice.

Figure 9:
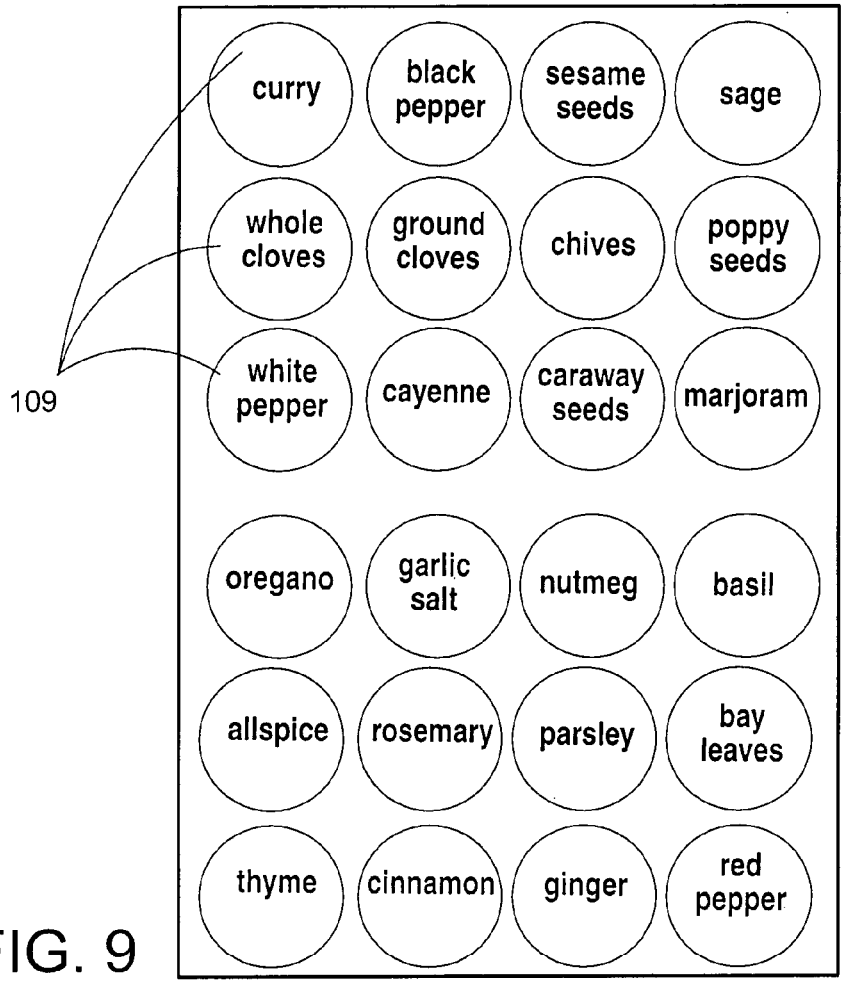
FIG. 9 shows a diagrammatic view illustrating a set of spice labels for the consumer kit shown in FIG. 8 according to a preferred embodiment of the present invention.

FIG. 9 shows a diagrammatic view illustrating a set 147 of spice labels 109 for the consumer kit 145 shown in FIG. 8 according to a preferred embodiment of the present invention.

As shown, preferably there are labels 109 of common spices in the consumer kit 145, marked with indicia, indicating the names of common spices. Upon reading this specification, those skilled in the art will understand that, under appropriate circumstances, such as commercial use, aesthetic considerations, etc., other types of labeling, such as labeling by symbols or colors, may suffice.

Figure 10:
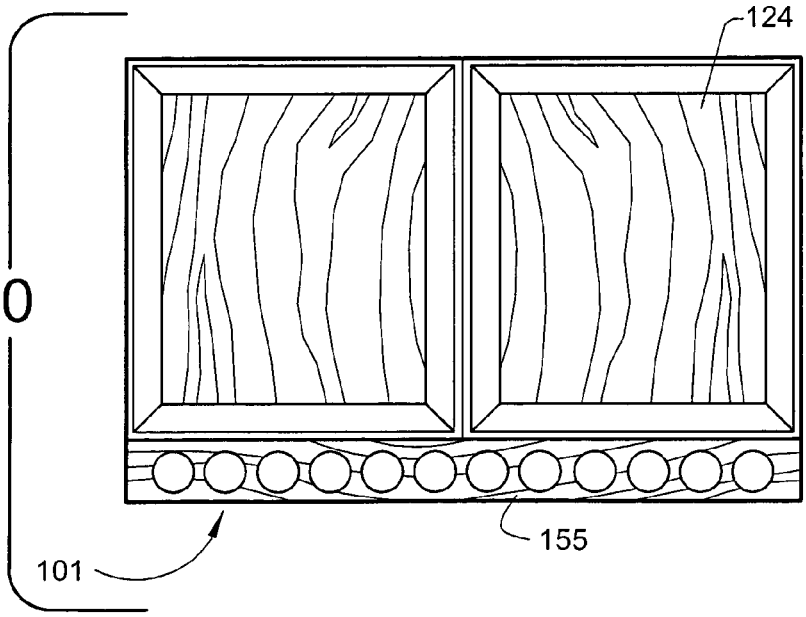
FIG. 10 shows a front view of the organizing system as installed on a cabinet structure according to a preferred embodiment of the present invention.

FIG. 10 shows a front view of the organizing system 101 as installed on a cabinet structure 124 according to a preferred embodiment of the present invention. Preferably, the consumer kit 145 is produced in a variety of standard cabinet finishes. Preferably, this enables the customer to purchase a consumer kit 145 with a finish 155 that closely matches that of the cabinet structure 124 on which the consumer kit 145 is to be installed. Preferably, the holder 102 will be available in a variety of standard cabinet finishes, for example, oak, maple, or pine. Upon reading this specification, those skilled in the art will understand that, under appropriate circumstances, such as commercial use, user preference, etc., other finishes such as paint, buffed metal, indicia, etc., may suffice.

Figure 11:
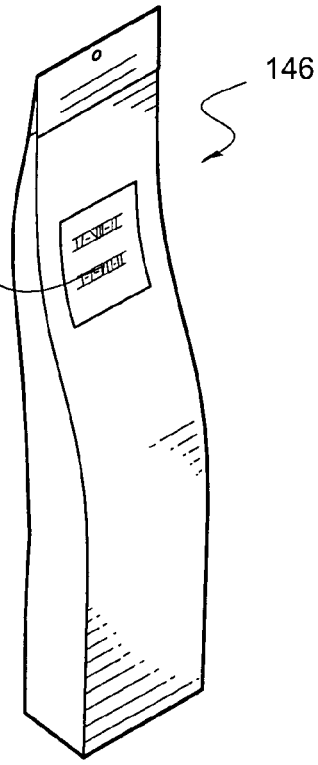
FIG. 11 shows a perspective view of a consumer packaging material to be used for the consumer kit of FIG. 8 according to a preferred embodiment of the present invention.

FIG. 11 shows a perspective view of a consumer packaging material 146 to be used for the consumer kit 145 of FIG. 8 according to a preferred embodiment of the present invention. Preferably, the consumer packaging material 146 has indicia 149 on it, which indicates the color finish 155 and size of the holder 102 (herein embodying wherein said consumer packaging material comprises indicia indicating at least one specific color and size). Upon reading the teachings of this specification, those with ordinary skill in the art, will now understand that, under appropriate circumstances, considering issues such as user preference, shipping considerations, economics, etc., other methods of packaging, such as boxes, cartons, etc., may suffice.

Figure 12:
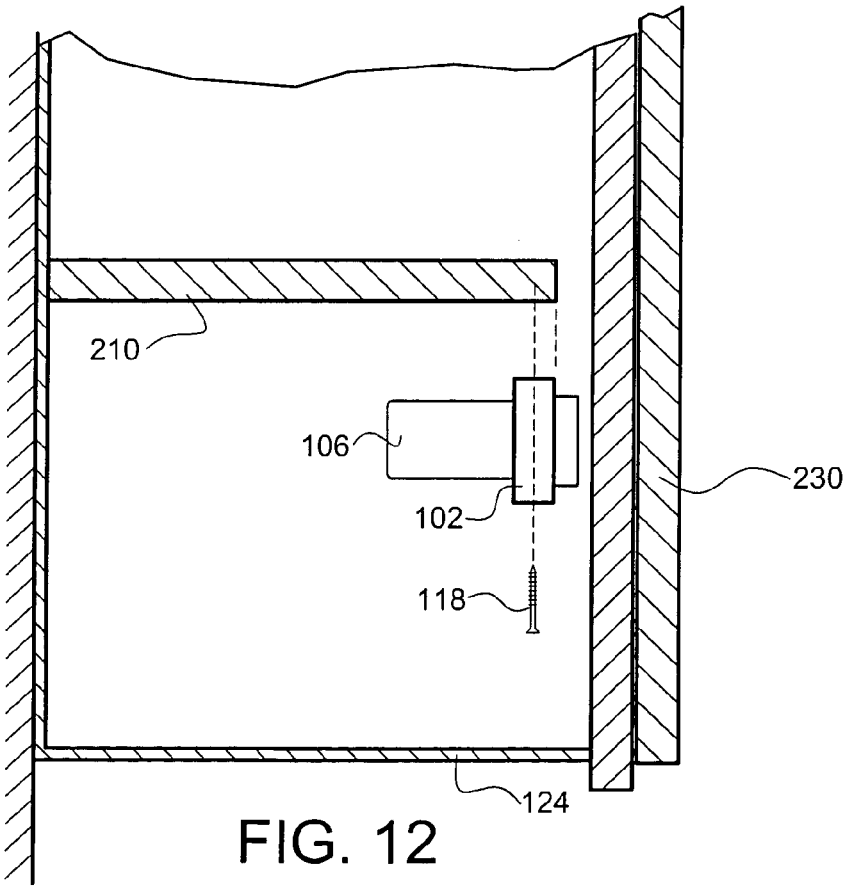
FIG. 12 shows a side sectional view through a section of a cabinet structure illustrating an alternate preferred installation embodiment of the present invention.

FIG. 12 shows a side sectional view through a section of a cabinet structure 124 illustrating an alternate preferred installation embodiment of the present invention. As shown in FIG. 12, the holder 102 may be installed under the shelf 210 inside a cabinet structure 124. For this installation, it is preferred that holder 102 be installed far enough back on the shelf to ensure that the cabinet door 230 can close when containers 106 are in place, as shown. Also, for this installation, it is preferred for holders 102 to be of the correct length to fit inside cabinet structure 124, and it is preferred for the apertures 104 to be spaced and arranged so as to be easily accessible inside cabinet structure 124, without being obstructed by the internal structure of cabinet structure 124.

In the illustrated embodiment in FIG. 12, the holder 102 is attached to the cabinet shelf 210 by inserting fasteners 118 upward through the holder 102 into cabinet shelf 210, as shown. Upon reading this specification, those skilled in the art will understand that, under appropriate circumstances, such as other materials, other uses, etc., other fastener attachments that adequately suspend the holder 102, such as bolts, adhesives, nails, clips, etc., may suffice.

Figure 13:
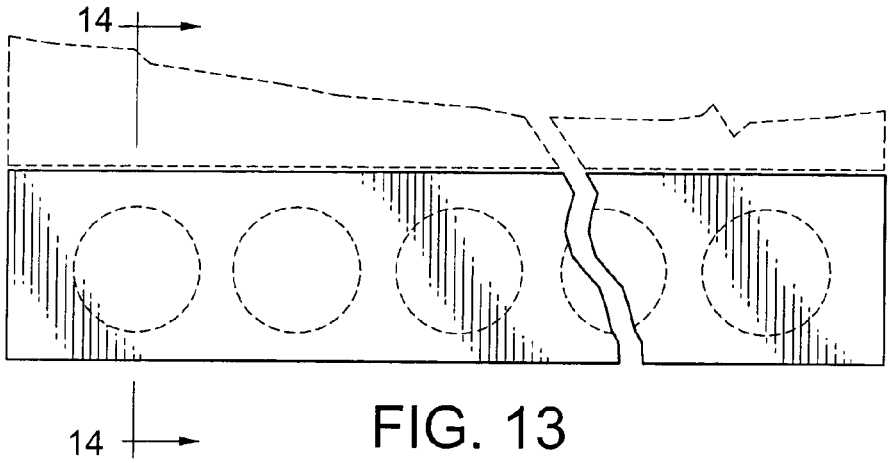
FIG. 13 shows a front view, partially in section, of an organizing system having a cover assembly according to an another preferred embodiment of the present invention.
Figure 14:
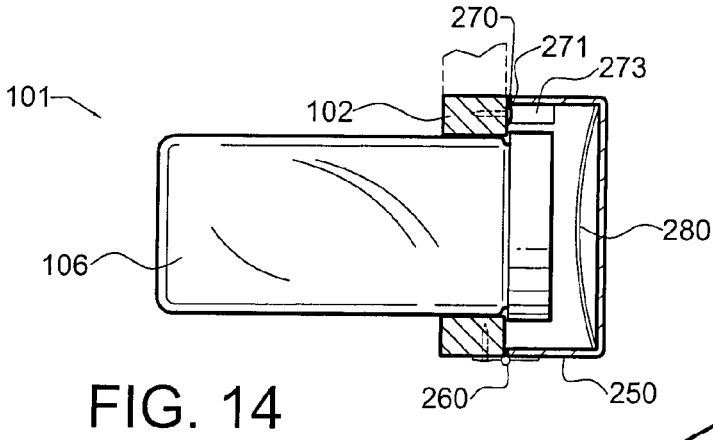
FIG. 14 shows a section view through section 14—14 of FIG. 13.
Figure 15:
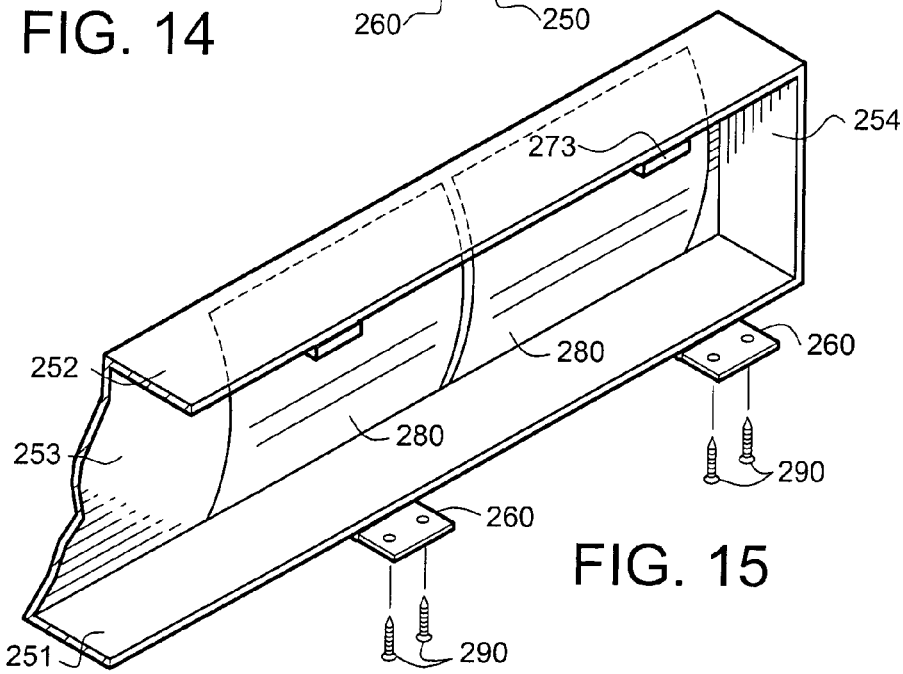
FIG. 15 shows a perspective view, partially in section of the cover assembly of FIG. 13.

FIG. 13 shows a front view, partially in section, of an organizing system 101 having a cover 250 according to another preferred embodiment of the present invention. FIG. 13 shows a partial view of organizing system 101 installed, with cover 250 in the closed position. FIG. 14 shows a section view through section 14—14 of FIG. 13. FIG. 15 shows a perspective view, partially in section of the cover assembly of FIG. 13.

FIG. 14 shows that organizing system 101 may have a cover 250 that is attached to holder 102, as shown (embodying herein at least one covering means structured and arranged to cover said plurality of long container means). Cover 250 may comprise hinge 260 (embodying herein wherein hinge means structured and arranged to flexibly connect said at least one covering means to said at least one substantially-vertical thin holding means) and latch 270 (embodying herein wherein latching means structured and arranged to latch said at least one covering means in a closed position), as shown. Cover 250 may hold cards 280, which may contain indicia or other information about the contents of adjacent containers 106, as shown in FIG. 15.

Preferably, cover 250 has a bottom side 251, a top side 252, a front side 253, and two ends 254 and 255 (not shown), so as to comprise a five sided box with one open side, as shown. Preferably, the open side of cover 250 fits over the front of holder 102 in use, preventing containers 106 from being splashed with food, oil, etc. Preferably, cover 250 may be made of various materials such as, for example, steel, plastic, wood, laminate, etc. Preferably, cover 250 will be available in various finishes to match standard cabinetry. Alternatively, cover 250 may be made of transparent plastic to permit the user to read labels 109 on containers 106 while cover 250 is closed. Upon reading this specification, those skilled in the art will understand that under appropriate circumstances, such as intended use, aesthetic design, etc., other materials and finishes may suffice.

Preferably, hinge 260 may be made of any suitable material, such as, for example, metal or plastic. Preferably, hinge 260 connects the bottom side of cover 250 with the bottom edge of holder 102 with fasteners 290, such that cover 250 may swing up to protect the front face of holder 102, or cover 250 may swing down to permit access to containers 106. Preferably, hinge 260 is spring-loaded to permit cover 250 to remain in its upright covering position without the need for a latch 270. Upon reading this specification, those of ordinary skill in the art will understand that under appropriate circumstances, such as aesthetic design, user preferences, materials requirements, durability, etc., other means of connecting cover 250 to holder 102, such as multiple hinges, frictional fitting, sliding, hanging, etc., may suffice.

Preferably, latch 270 is a magnetic latch, with magnet 273 on the top edge of cover 250 aligning with a steel or iron fixture 271 on holder 102 such that when cover 250 is closed magnet 273 holds cover 250 closed against iron fixture 271, as shown. Alternatively, latch 270 may be a frictional fitting or other type of latch configured to hold cover 250 closed. Upon reading this specification one of ordinary skill in the art will understand that under appropriate circumstances, such as size of the organizer, intended use, materials, etc., other arrangements of closures, such as spring-loaded hinges, multiple latches, arranged to latch said at least one covering means in a closed position), as shown. Cover 250 may hold cards 280, which may contain indicia or other information about the contents of adjacent containers 106, as shown in FIG. 15.

Preferably, cover 250 has a bottom side 251, a top side 252, a front side 253, and two ends 254 and 255 (not shown), so as to comprise a five sided box with one open side, as shown. Preferably, the open side of cover 250 fits over the front of holder 102 in use, preventing containers 106 from being splashed with food, oil, etc. Preferably, cover 250 may be made of various materials such as, for example, steel, plastic, wood, laminate, etc. Preferably, cover 250 will be available in various finishes to match standard cabinetry. Alternatively, cover 250 may be made of transparent plastic to permit the user to read labels 109 on containers 106 while cover 250 is closed. Upon reading this specification, those skilled in the art will understand that under appropriate circumstances, such as intended use, aesthetic design, etc., other materials and finishes may suffice.

Preferably, hinge 260 may be made of any suitable material, such as, for example, metal or plastic. Preferably, hinge 260 connects the bottom side of cover 250 with the bottom edge of holder 102 with fasteners 290, such that cover 250 may swing up hinge 260 and latch 270), cards 280, and fasteners 290 (herein embodying wherein said kit contents further comprise at least one set of cards; and further embodying herein wherein said kit contents further comprise at least one latch; and further embodying herein wherein said kit contents further comprise at least one hinge). Cover 250 may be sold with cover 250 already installed or cover 250 may be optionally installed by the user (herein embodying wherein the step of installing at least one cover on said at least one substantially-vertical thin holder). Cards 280 may be blank or may have indicia. As a preferred alternate embodiment, a template is provided in the consumer kit 145 on compact disc 160 (herein embodying wherein said kit contents further comprise at least one compact disk program for creating cards) so that customized cards can be created from the blank cards 280 (herein embodying creating a plurality of cards for such plurality of long containers). Those skilled in the art of label production with software will be able, without undue experimentation, to provide such program and template, etc.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. An organizing system for organizing a plurality of items comprising:

a) a plurality of long container means for holding the plurality of items;

b) at least one substantially-vertical thin holding means for holding said plurality of long container means in at least one substantially horizontal position;

c) wherein said at least one substantially-vertical thin holding means comprises a plurality of apertures; and d) at least one fastening means for fastening said at least one substantially-vertical thin holding means to at least one support structure;

e) wherein, when at least one of said plurality of long container means is placed substantially through at least one of said plurality of apertures, a center of gravity of said at least one of said plurality of long container means effects a tilting of said at least one of said plurality of long container means such that, in combination with a small enough clearance between a diameter of said at least one of said plurality of apertures and a diameter of said at least one of said plurality of long container means, said at least one of said plurality of long container means is firmly held in said at least one of said plurality of apertures;

f) at least one covering means structured and arranged to cover said plurality of long container means; and g) at least one hinge means structured and arranged to flexibly and directly connect said at least one covering means to said at least one substantially-vertical thin holding means.

2. The organizing system according to claim 1 further comprising at least one capping means for capping said at least one of said plurality of long container means.

3. The organizing system according to claim 2 wherein said at least one capping means, when installed on said at least one of said plurality of long container means, comprises at least one stopping means, for said at least one of said plurality of long container means, for preventing said at least one of said plurality of long container means from passing all the way through said at least one of said plurality of apertures of said at least one substantially-vertical thin holding means.

4. The organizing system according to claim 3 further comprising at least one fastener retaining means for retaining said at least one fastening means within said at least one substantially-vertical thin holding means.

5. The organizing system according to claim 1 further comprising at least one position adjusting means to adjust at least one position of said at least one substantially-vertical thin holding means to permit removable access of said at least one of said plurality of long container means.

6. The organizing system according to claim 1 further comprising at least one sifting means for sifting the plurality of items inside of said at least one of said plurality of long container means when said at least one of said plurality of long container means is inverted and shaken.

7. The organizing system according to claim 1 further comprising at least one labeling means for labeling said plurality of long container means.

8. The organizing system according to claim 1 wherein said plurality of said long container means is for holding a plurality of spices.

9. The organizing system according to claim 1 further comprising at least one guarding means structured and arranged to guard said plurality of long container means.

10. The covering means according to claim 1 further comprising at least one latching means structured and arranged to latch said at least one covering means in a closed position.

11. The organizing system according to claim 1 wherein said at least one of said plurality of long container means comprises at least one stopping means, for said at least one of said plurality of long container means, for preventing said at least one of said plurality of long container means from passing all the way through said at least one of said plurality of apertures of said at least one substantially-vertical thin holding means.

12. An organizing system for organizing a plurality of spices comprising;

a) a plurality of long containers structured and arranged to hold the plurality of spices;

b) at least one substantially-vertical thin holder structured and arranged to bold said plurality of long containers in at least one substantially horizontal position; and c) at least one fastener structured and arranged to fasten said at least one substantially-vertical thin bolder to at least one support structure;

d) wherein said at least one substantially-vertical thin holder comprises a plurality of apertures structured and arranged to hold said plurality of long containers for removable access;

e) wherein when at least one of said plurality of long containers is placed substantially through at least one of said plurality of apertures, said at least one of said plurality of apertures is structured and arranged to provide at least one friction hold around at least one circumferential portion of said at least one of said plurality of long containers; and f) wherein a center of gravity position of said at least one of said plurality of long containers is spaced from said holder thereby aiding said at least one friction hold;

g) at least one cover structured and arranged to cover said plurality of long containers: and h) at least one hinge structured and arranged to flexibly and directly connect said at least one cover to said at least one substantially-vertical thin bolder.

13. The organizing system according to claim 12 further comprising at least one retainer structured and arranged to retain said at least one fastener within said at least one substantially-vertical thin holder.

14. The organizing system according to claim 12 further comprising at least one position adjuster structured and arranged to adjust at least one position of said at least one substantially-vertical thin holder to ensure removable access of said at least one of said plurality of long containers.

15. The organizing system according to claim 12 further comprising at least one cap structured and arranged to cap said at least one of said plurality of long containers.

16. The organizing system according to claim 15 wherein said at least one cap, when installed on said at least one of said plurality of long containers, provides at least one stop for said at least one of said plurality of long containers, to prevent said at least one of said plurality of long containers from passing all the way through said at least one of said plurality of apertures of said at least one substantially-vertical thin holder.

17. The organizing system according to claim 12 further comprising at least one sifter structured and arranged to sift at least one of said plurality of spices inside of said at least one of said plurality of long containers when said at least one of said plurality of long containers is inverted and shaken.

18. The organizing system according to claim 12 further comprising at least one label structured and arranged to label said at least one of said plurality of long containers.

19. The organizing system according to claim 18 wherein said at least one label comprises indicia.

20. The organizing system according to claim 12 further comprising at least one guard structured and arranged to guard said plurality of long containers.

21. The organizing system according to claim 12 further comprising at least one latch structured and arranged to latch said at least one cover in a closed position.

22. The organizing system according to claim 12 wherein said at least one of said plurality of long containers further comprises at least one stop for preventing said at least one of said plurality of long containers from passing all the way through said at least one of said plurality of apertures of said at least one substantially-vertical thin holder.

23. The organizing system according to claim 12 further comprising:

a) a plurality of caps structured and or ranged to cap at least one of said plurality of long containers; and b) a plurality of sifters structured and arranged to sift said plurality of spices inside of said plurality of long containers when said plurality of long containers are inverted and shaken.

24. A consumer kit for a spice organizing system comprising:

a) kit contents; and b) consumer packaging material packaging said kit contents;

c) wherein said consumer packaging material comprises indicia indicating at least one specific color and size; and d) wherein said kit contents comprise (i) at least one set of spacers, (ii) at least one set of long containers, (iii) at least one set of cover caps, (iv) at least one set of sifters, (v) at least one set of labels, (vi) at least one compact disc containing a program for assisting creating said at least one of labels, (vii) at least one holder, wherein said holder comprises at least one fastener retainer, (viii) at least one set of fasteners, (ix) at least one set of instructions for installation of the spice organizing system (x) at least one set of cards, (xi) at least one compact disc containing a program for assisting creating said at least one set of cards;

(xii) at least holder cover, and (xiii) at least one hinge.

25. The consumer kit according to claim 24 further comprising at least one latch.

26. A method, for a spice organizing system, comprising the steps of:

a) measuring at least one support structure on which to install the spice organizing system;

b) selecting at least one consumer kit for the spice organizing system which is appropriately sized and color-matched to the at least one support structure;

c) drilling at least one pilot hole in the at least one support structure;

d) setting a location of at least one substantially-vertical thin holder such that said spice organizing system, when installed, will be in a position that provides removable access for a plurality of long containers held within; and e) installing at least one fastener through such at least one substantially-vertical thin holder and into the at least one support structure for retention of such at least one substantially-vertical thin holder f) filling such plurality of long containers with a plurality of items;

g) installing a plurality of sifters on such plurality of long containers;

h) installing a plurality of caps to enclose such plurality of long containers;

i) creating a plurality of labels for such plurality of long containers;

j) placing such plurality of labels on such plurality of caps to identify a plurality of contents inside of such plurality of long containers;

k) selecting at least one aperture of such at least one substantially-vertical thin holder into which at least one of such plurality of long containers should be stored; and l) placing such at least one of such plurality of long containers in such at least one aperture of such at least one substantially-vertical thin holder such that the center of gravity of such plurality of long containers is spaced from such at least one substantially-vertical thin holder;

m) creating a plurality of cards for such plurality of long containers; and n) placing such plurality of cards on at least one cover of the such at least one substantially-vertical thin holder to identify a plurality of contents inside of such plurality of long containers;

o) directly attaching such at least one cover to such at least one substantially vertical thin holder.

27. The method according to claim 26 further comprising the step of installing the at least one cover on said at least one substantially-vertical thin holder.

28. The method according to claim 26 wherein at least one spacer of appropriate size is used in said setting step.

* * * * *

UNITED STATES PATENT AND TRADEMARK OFFICE

CERTIFICATE OF CORRECTION

PATENT NO. : 6,964,343 B2
DATED : November 15, 2005
INVENTOR(S) : Tilly, Jeffrey It is certified that error appears in the above-identified patent and that said Letters Patent is hereby corrected as shown below:

Column 18,
Line 14, “arranged to bold” should read -- arranged to hold --.
Lines 17 and 37, “thin bolder” should read -- thin holder --.

Column 19,
Line 15, “structured and or ranged” should read -- structured and arranged --.
Line 36, after “at least one” insert -- set --.

Signed and Sealed this

Thirty-first Day of January, 2006

JON W. DUDAS
*Director of the United States Patent and Trademark Office*